United States Patent [19]

Seinecke

[11] 4,044,320

[45] Aug. 23, 1977

[54] COAXIAL 1 OF N RELAY TRANSFER SWITCH HAVING REED CONTACTS

[75] Inventor: Siegfried Seinecke, Soecking, Germany

[73] Assignee: Siemens Aktiengesellschaft, Berlin & Munich, Germany

[21] Appl. No.: 688,888

[22] Filed: May 21, 1976

[30] Foreign Application Priority Data

Sept. 30, 1975 Germany ..... 2543669

[51] Int. Cl.[2] ..... H01P 1/10

[52] U.S. Cl. ..... 333/7 R; 335/5

[58] Field of Search ..... 333/7 R; 335/4, 5, 152

[56] References Cited

U.S. PATENT DOCUMENTS 3,461,386 8/1969 McCutcheon et al. ..... 335/5 X

*Primary Examiner*—Paul L. Gensler

*Attorney, Agent, or Firm*—Hill, Gross, Simpson, Van Santen, Steadman, Chiara & Simpson

[57] ABSTRACT

A coaxial 1-of-*n* relay transfer switch has reed switches arranged in electrically conductive, non-magnetic tubes. The reed switches are arranged in a star configuration in such a way that one terminal of each reed switch is connected to a branching point within a metallic head enclosing the branching point, and are connected to the inner conductor of a coaxial input line at the metallic head. The other end of each reed switch is connected to a coaxial output line. The metallic head and the metallic tubes which enclose the reed switches are constructed, with respect to their interiors, that, viewed electrically, they add inductances between the inner conductor of the coaxial input line and the branching point, on the one hand, and, on the other hand, between the branching point and the reed switches.

6 Claims, 6 Drawing Figures

COAXIAL 1 OF N RELAY TRANSFER SWITCH HAVING REED CONTACTS

CROSS REFERENCE TO RELATED APPLICATION

This application is related to my application entitled "A Coaxial **2-of-*n*** Relay Transfer Switch Having Reed Contacts," filed concurrently herewith Ser. No. 688,889.

BACKGROUND OF THE INVENTION

1. Field of the Invention

This invention relates to a coaxial **1-of-*n*** relay transfer switch having reed switches (reed contacts) arranged in respective electrically conductive, non-magnetic tubes, the reed switches being arranged in a star configuration in such a way that one end of each reed switch connects with like ends of the other reed switches at a branching point within a metallic head enclosing the branching point, and are there connected to an inner conductor of a coaxial input line, and the other ends of the reed switches are connected to respective coaxial output lines.

2. Description of the Prior Art

In test devices for rapid digital switching circuits the object often exists to connect, in a program-controlled manner, one of $n$ input terminals of a test object to the output of a generator, and to an input of an oscillograph via coaxial lines and transfer switches. The connection is to be accomplished in such a manner that, down to signal rise times of 0.5 ns, the network formed in each case represents, to the greatest possible extent, a reflection-free, wide-band 50 ohm coaxial connection of specific electrical length. The same is true for the program-control connection between one of $q$ outputs of the test object and another input of the oscillograph.

A technical solution for the above problem is commonly found in relay matrices having one input and $n$ or $q$, respectively, outputs, for example $n = q = 64$, which are composed of individual relay transfer switches connected in cascade, for example in the configuration 1-of-4.

FIG. 1 illustrates the basic circuit diagram of a 1-of-4 transfer switch of the type just mentioned. The coaxial input line E1 is to be connected, via one of the four relay-controlled reed switches ***r*1 . . . *r*4** to one of the four coaxial output lines in such a way that, to the extent possible, a reflection-free, low distortion and low attenuation pulse transmission is possible in both transmission directions.

In order to accomplish this objective, various possibilities have become known in the art. Thus, for example, it is known to arrange the four reed switches belonging to a 1-of-4 transfer switch next to one another on a printed circuit board, to connect the reed switches on one side to one another and to connect a 50 ohm input line to this connection, while the other ends of the reed switches are directly connected to 50 ohm output lines.

Further, it has become known to arrange four reed switches in a star shape on the top side of a multi-layer printed circuit board and to enclose the branching point of the contacts on the top of the multi-layer printed circuit board within a metallic head, into which a coaxial plug connection is inserted from the bottom side of the multi-layer printed circuit board. The reed switches are connected to coaxial output plug connections in that the connecting legs of the reed switches are connected to soldering eyes, and 50 ohm strip lines extend from the soldering eyes to the coaxial output plug connections. In order to transfer, in the region of the soldering eyes, the quasi-coaxial lines, which the inner conductors form with the copper tubes enclosing the reed switches, as jolt-free as possible into the 50 ohm strip lines, the tube ends are connected to the ground plane of the printed circuit board, by way of wires and other soldering eyes.

For the following reasons, arrangements of this type cannot be produced with sufficient band width and sufficiently low reflection:

1. The junctions from the reed contacts to the 50 ohm strip lines with connection wires and a zero volt wire are affected by mechanical shock.
2. The soldering eyes disturb the lines with a capacitance of about 2 pF at about zero volts.
3. The junctions from the 50 ohm strip lines to the output sockets are affected by mechanical shock.

Therefore, fundamental reflections of $>20\%$ (at 150 ps generator rise time), band widths of $<1$ GHz and residual time constants of $>500$ ps are to be anticipated.

SUMMARY OF THE INVENTION

The object of the present invention, therefore, is to provide a **1-of-*n*** relay transfer switch having reed switches, which transfer switch is extremely wide band and of low reflection and, additionally, has small transit time differences between the individual paths.

Another object of the invention is to provide a wide band low reflection **1-of-*n*** relay transfer switch with reed contacts which can be produced and installed as a module having uniform, close tolerance electrical data.

According to the invention, the above objects are achieved in that the metallic head and the metallic tubes enclosing the reed switches have an interior construction which, when viewed electrically, add inductance between the inner conductor of the coaxial input line and the branching point of the reed contacts, on the one hand, and between the branching point and the contacting points of the reed contacts on the other hand. Particularly good values are achieved when the portions of the head and tubes which face the branching point are constructed in the form of an exponential horn.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
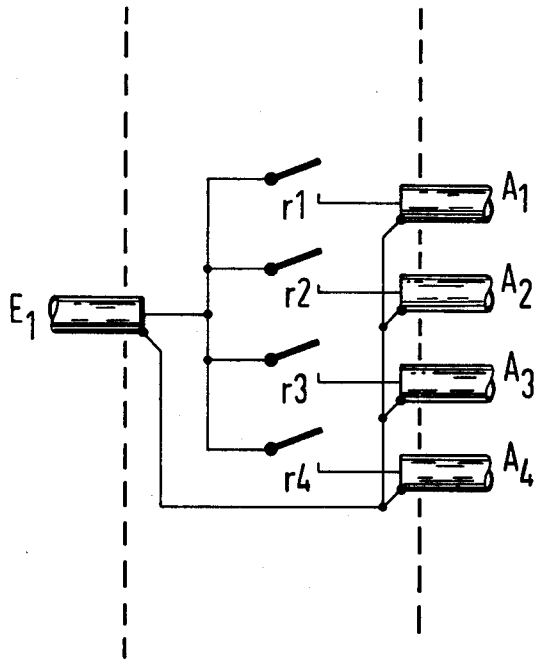
FIG. 1 is a basic circuit diagram of a 1-of-4 relay transfer switch.

FIG. 1 illustrates the wiring of a 1-of-4 relay transfer switch connected between a coaxial input line $E_1$ and a plurality of coaxial output lines $A_1$---$A_4$. In the transfer switch the outer conductors of the input and output lines are electrically connected together. The inner conductor of the input line $E_1$ is selectively connected to the inner conductor of the respective output lines $A_1$---$A_4$ by way of respective switches ***r*1---*r*4.**

Figure 2:
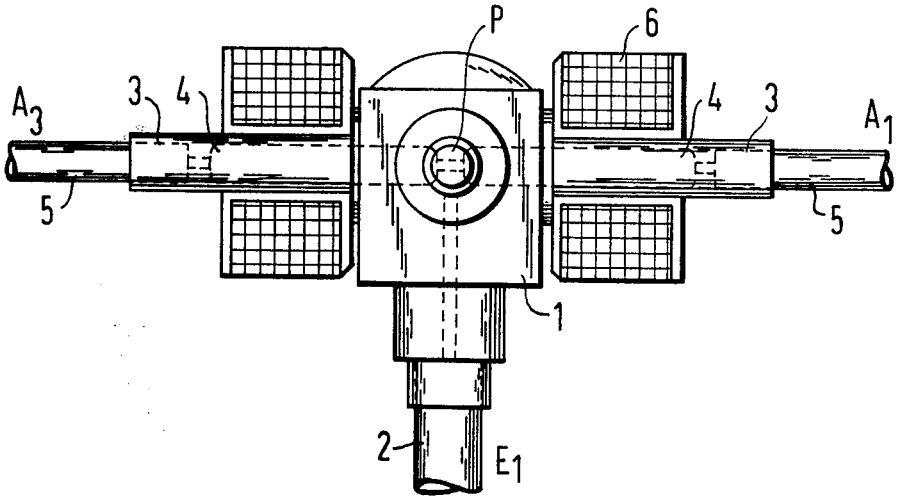
FIGS. 2 and **2*a* are elevation and plan views of a 1-of-4** relay transfer switch constructed in accordance with the present invention and illustrating the arrangement of the reed switches.
Figure 2A:
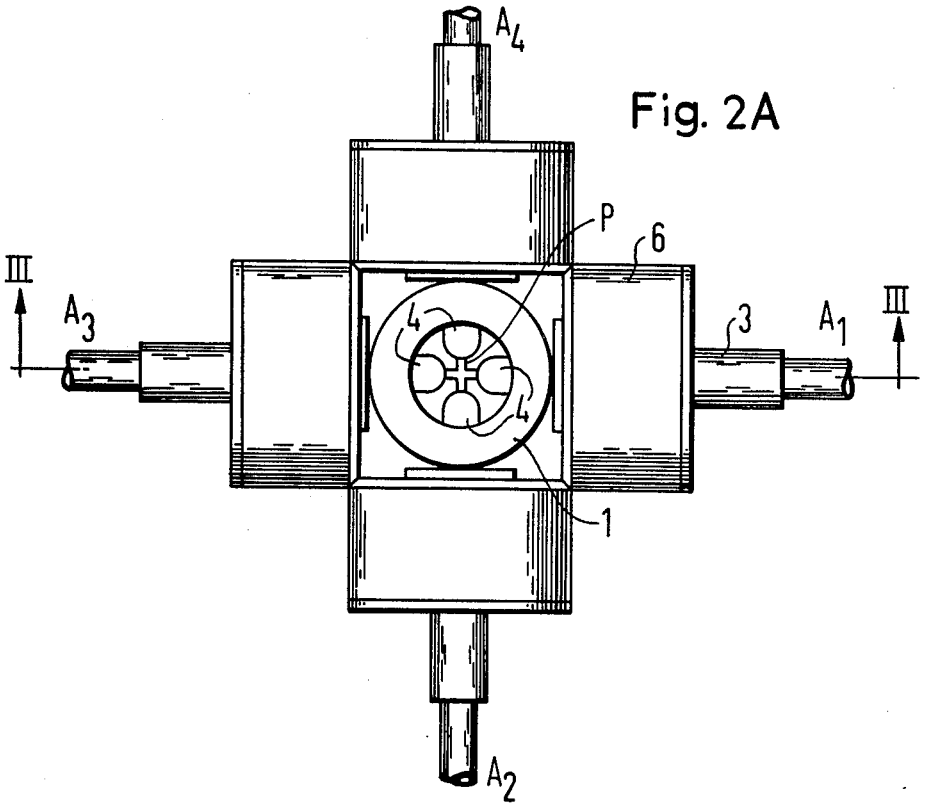

Referring now to FIGS. 2 and 2A, the basic structure of a 1-of-4 transfer switch, constructed with reed switches, is illustrated. A metallic head 1 includes a center P (later to be identified as a branching point) which is connected to the inner conductor of a coaxial input line 2 at an input $E_1$. The point P, as best seen in FIG. 2A, defines a branching point for four radially extending reed switches 4. Each of the reed switches includes a pair of reed contacts and are housed in electrically conductive, non-magnetic tubes, for example copper tubes, 3 and extend from the branching point P to the respective output lines 5 at the outputs $A_1$--$A_4$. Each reed switch has an operating winding 6 assigned thereto for operation in a manner well known in the art.

Figure 3:
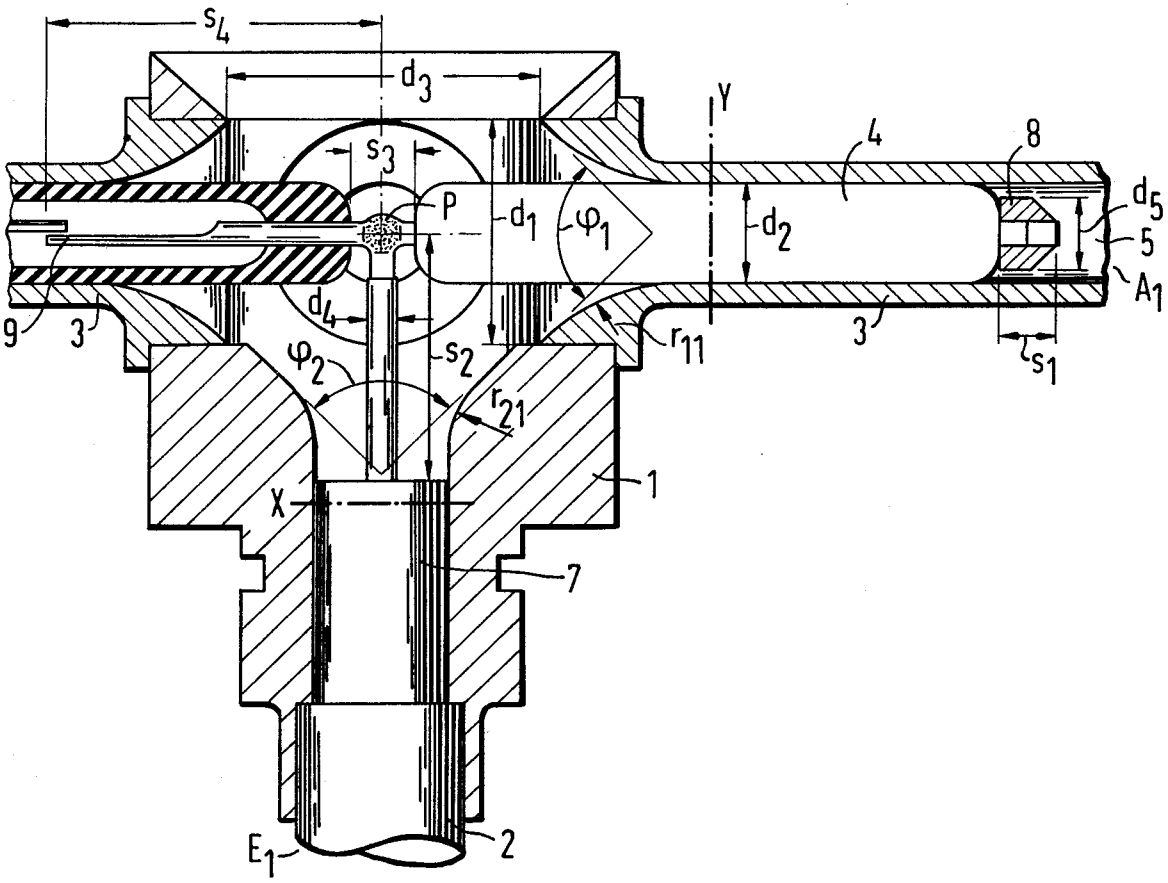
FIG. 3 is a sectional view taken substantially along the line III—III of FIG. 2A.

Referring to FIG. 3, the metallic head 1 is illustrated in greater detail. The input line 2 includes a dielectric 7 between the inner and outer conductors which extends within the head 1 so that a homogeneous 50 ohm coaxial line is formed up to a zone X. For purpose of illustration, it is assumed that the reed contacts of the reed switch 4 extending to the right in FIG. 3 are closed, and that the contacts of the remaining three reed switches are open (connection $E_1$--$A_1$ in FIG. 1). Based on the construction of the tubes 3 (the diameter $d_2$) and of a copper bead 8, then, from a zone Y on toward the right in close proximity with the tube 3, the closed reed contacts form a homogeneous 50 ohm coaxial line which changes over into the 50 ohm output line 5.

The connection line $E_1$--P--$A_1$ illustrated in FIG. 3 is, however, not homogeneous in the section X--P--Y, especially because at the point P the reed contacts 9 of the three open reed switches are connected and their capacitance, vis-a-vis the tube 3 and the head 1, leads to a capacitive loading $C_p$ of the conduction line X--P--Y at the point P. Since the transmission band width and the reflection which are achievable are directly proportional to the capacitance $C_p$, this capacitance must be made as small as possible by the geometry of the transfer switch.

In order that the length $s_4$ of the open reed contacts, and thus the capacitance $C_p$ be kept small, the four contacts are initially moved so far together toward the branching point P that the glass encapsulating the reed contacts touch one another. With a radial arrangement of five or more reed switches it would be necessary to move the contacts apart, which would increase the capacitance $C_p$ and which strongly reduce the achievable band width.

Figure 4:
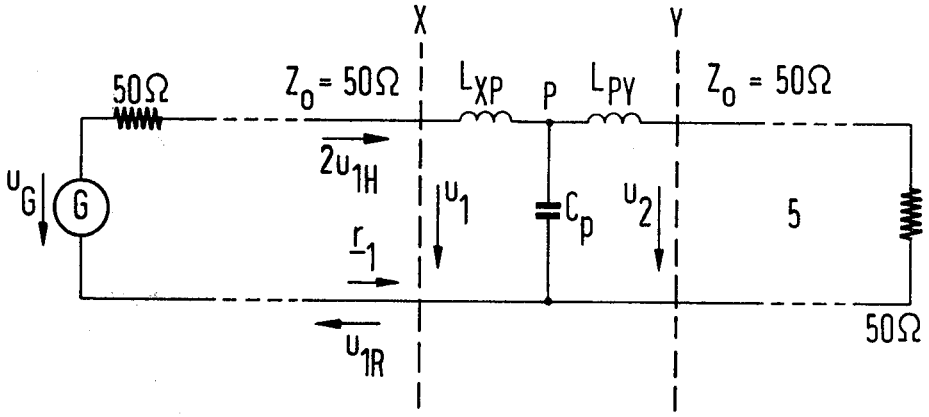
FIG. 4 is an equivalent circuit diagram of the apparatus illustrated in FIG. 3.

In FIG. 4, an approximate equivalent electrical circuit is illustrated for the critical section X--P--Y of the transfer switch. For evaluating the dynamic characteristics, an examination of the transfer switch with a pulse reflectometer is offered. The pulse reflectometer activates the transfer switch by way of the input line 2 with a wave $u_{1H}(t)$. The transfer switch has optimum characteristics, when the reflected wave $u_{1R}(t)$ at the input is as small as possible and the output voltage $u_2(t)$ corresponds in shape and amplitude as nearly as possible with the wave $u_{1H}(t)$. The undesirable effect of the disruptive capacitance $C_p$ can now, according to the present invention, be reduced in that, according to FIG. 4, between the zone X and the zone P, as well as between the zone P and the zone Y, longitudinal (series) inductances, as viewed electrically, are intentionally inserted, which inductances supplement the section X--P--Y (FIG. 3) to form a low pass T filter section. Practically, this occurs as a result of the flaring out of the head 1 and the tubes 3 in the vicinity of the branching point P. Not only the head 1 flares ($r_{21}$,$\phi_2$) but also the tubes 3 flare ($r_{11}$, $d_1$, $\phi_1$) to provide internal ends which are respectively in the form of an exponential horn. The inductance $L_{XP}$ can, depending on the dimensions of the reed switches and the input line, be controlled by the values of the radius $r_{21}$, the angle $\phi_2$, the interval $s_2$ from the branching point P to the beginning of the dielectric 7 of the input line 2 and by the diameter $d_4$ to which the inner conductor of the input line has been reduced over the path $s_2$.

The inductance $L_{PY}$ can be influenced by the cylindrical bore $d_3$ of the head 1, by the funnel diameter $d_1$ of the tubes 3, by the diameter $d_2$ of the tubes 3 and by the distance $s_3$ of the reed switches. All of these parameters also act simultaneously on the capacitance $C_p$.

The cross-section junctions in the space X--P and the space P--Y are constant (smooth); in this manner distortions of the electromagnetic field, such as occur at abrupt junctions, are avoided; and the greatest possible band width is achieved.

The capacitance $C_p$ may also be reduced by the use of asymmetrical reed contacts; these contacts having one long reed spring and one short reed spring, wherein the short reed spring would be installed toward the branching point P. Unfortunately, contacts of this type are only generally supplied with contact resistances of $>150$ m-ohm.

Figure 5:
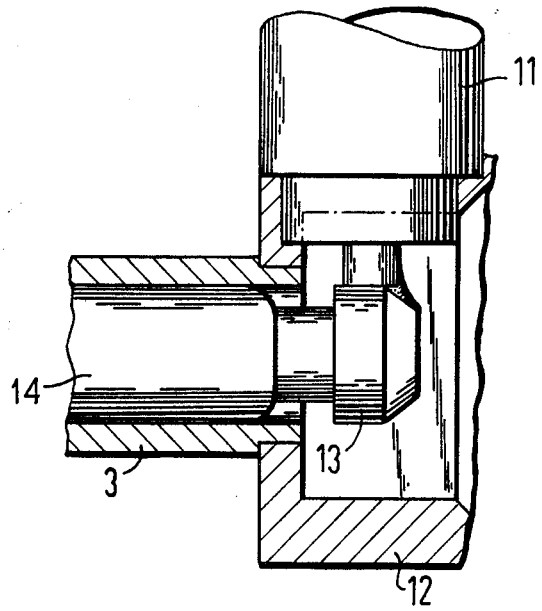
FIG. 5 is a sectional view of an exemplary embodiment of an output pot-shaped member for connection to an output line.

For some applications, it is necessary that the output lines not be connected radially, as illustrated in FIG. 3, but rather axially in the smallest possible space and thus parallel to the input line. FIG. 5 illustrates an output coupling in which a pot-shaped member 12 is provided at each of the distal ends of the four tubes 3. The inner conductor of the outgoing line 11 is connected to the contact 5 by way of a metallic bead 13. With an optimization of dimensions, the return is practically free of shock and the transfer switch has reflections of 3% and a residual time constant $\tau_E$ of 100 ps.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A coaxial **1-of-*n*** relay transfer switch, where *n* is an integer, comprising an input coaxial line and *n* output coaxial lines, each coaxial line including an inner conductor and an outer conductor,

*n* reed switches arranged in a star configuration and each including reed contacts and first and second reed terminals, said first reed terminals connected together to form a branching point, said branching point connected to said inner conductor of said input line and having a capacitive loading which is dependent on the number of open reed switches connected to said branching point,

*n* metallic, non-magnetic tubes each enclosing a respective reed switch and connected to an outer conductor of a respective output line, and a metallic head electrically connected to said tubes and to said outer conductor of said input line, said head enclosing said branching point, the interior walls of said head and tubes constructed to add inductance between said inner conductor of said coaxial input line and said branching point and between said branching point and said reed contacts to reduce the capacitive loading effect and form a low pass T filter section.

2. A coaxial **1-of-*n* relay transfer switch according to claim 1**, wherein the ends of said tubes which face in the direction of said branching point include an inner surface in the form of an exponential horn.

3. A coaxial **1-of-*n* relay transfer switch according to claim 1**, comprising short coaxial line pieces connecting respective second reed terminals and output coaxial lines.

4. A coaxial **1-of-*n* relay transfer switch according to claim 1**, comprising metallic beads connecting respective second reed terminals to said inner conductors of said output lines.

5. A coaxial **1-of-*n* relay transfer switch according to claim 1**, comprising a respective pot-shaped member housing each of said second reed terminals and a metallic bead in each pot-shaped member connecting said second reed terminal to said inner conductor of the respective output line in a 90° relation thereto.

6. A coaxial **1-of-*n*** relay transfer switch, where *n* is an integer, comprising $n + 1$ coaxial lines each including an inner conductor and an outer conductor,

*n* reed switches arranged in a star configuration and each including reed contacts, a first reed terminal and a second reed terminal, said first reed terminals connected together forming a branching point, said branching point connected to an inner conductor of one of said coaxial lines, said second reed terminals connected to said inner conductors of respective others of said coaxial lines, said branching point having a capacitive loading which is dependent on the number of open reed switches connected to said branching point,

*n* metallic, non-magnetic tubes each housing a respective reed switch and connected at one end thereof to the outer conductor of a respective other coaxial line, a metallic head enclosing said branching point and connected to the other end of each of said tubes and to said outer conductor of said one coaxial line, said tubes and said head including walls shaped to add inductance between said inner conductor of said one coaxial line and said branching point and between said branching point and said reed contacts to reduce the capacitive loading effect and form a low pass T filter section.

* * * * *